US007673369B2

(12) United States Patent
Gogel et al.

(10) Patent No.: US 7,673,369 B2
(45) Date of Patent: Mar. 9, 2010

(54) FLOOR CLEANING APPARATUS WITH FILTER CLEANING SYSTEM

(75) Inventors: Nathan A. Gogel, Hustonville, KY (US); Yasushi Kondo, Wade-Gun (JP); Donald E. Proffitt, Richmond, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 1154 days.

(21) Appl. No.: 11/188,155

(22) Filed: Jul. 22, 2005

(65) Prior Publication Data

US 2007/0017064 A1 Jan. 25, 2007

(51) Int. Cl.
*A47L 9/10* (2006.01)
*A47L 9/20* (2006.01)

(52) U.S. Cl. ..... 15/352; 15/353

(58) Field of Classification Search ..... 15/347, 15/352, 353; *A47L 9/10, 9/20*
See application file for complete search history.

(56) References Cited

U.S. PATENT DOCUMENTS

| | | | | |
|---|---|---|---|---|
| 2,210,950 | A | 8/1940 | Replogle | |
| 4,329,161 | A | 5/1982 | Osborn | |
| 4,533,371 | A | 8/1985 | Nakamura | |
| 5,657,508 | A * | 8/1997 | Herbreteau et al. | 15/315 |
| 2004/0163202 | A1 | 8/2004 | Yoshimi et al. | |
| 2006/0010641 | A1 * | 1/2006 | Nam et al. | 15/352 |

FOREIGN PATENT DOCUMENTS

| | | |
|---|---|---|
| EP | 1 118 303 | 7/2001 |
| EP | 1 504 710 | 3/2006 |
| GB | 2 280 388 | 1/1995 |
| JP | 45-86072 | 9/1970 |
| JP | 48-10547 | 1/1973 |
| JP | 54116778 | 1/1979 |
| JP | 2003-519520 | 6/2003 |
| JP | 2004358031 | 6/2003 |
| JP | 2004358135 | 12/2004 |

* cited by examiner

*Primary Examiner*—David A Redding
(74) *Attorney, Agent, or Firm*—King & Schickli, PLLC

(57) ABSTRACT

A floor cleaning apparatus includes a dirt collection vessel and a suction generator carried on the housing. The dirt collection vessel includes a dirty air inlet, a dirt collection chamber and a clean air outlet. A filter is received in the dirt collection vessel. The filter includes multiple sections. Each section provides a discrete airflow pathway. In addition, the floor cleaning apparatus includes a flow control valve assembly including a clean air inlet. The flow control valve assembly is selectively displaceable between two positions. In the first position dirty air is serially moved by the suction generator through the dirty air inlet, the dirt collection chamber, the filter and the clean air outlet so that dirt is collected in the dirt collection chamber. In the second position clean air is moved by the suction generator through the clean air inlet, a selected one of the sections of the filter, back through the other sections of the filter and then through the clean air outlet. In this way dirt is cleaned from the selected filter of the filter.

24 Claims, 7 Drawing Sheets

Fig. 6
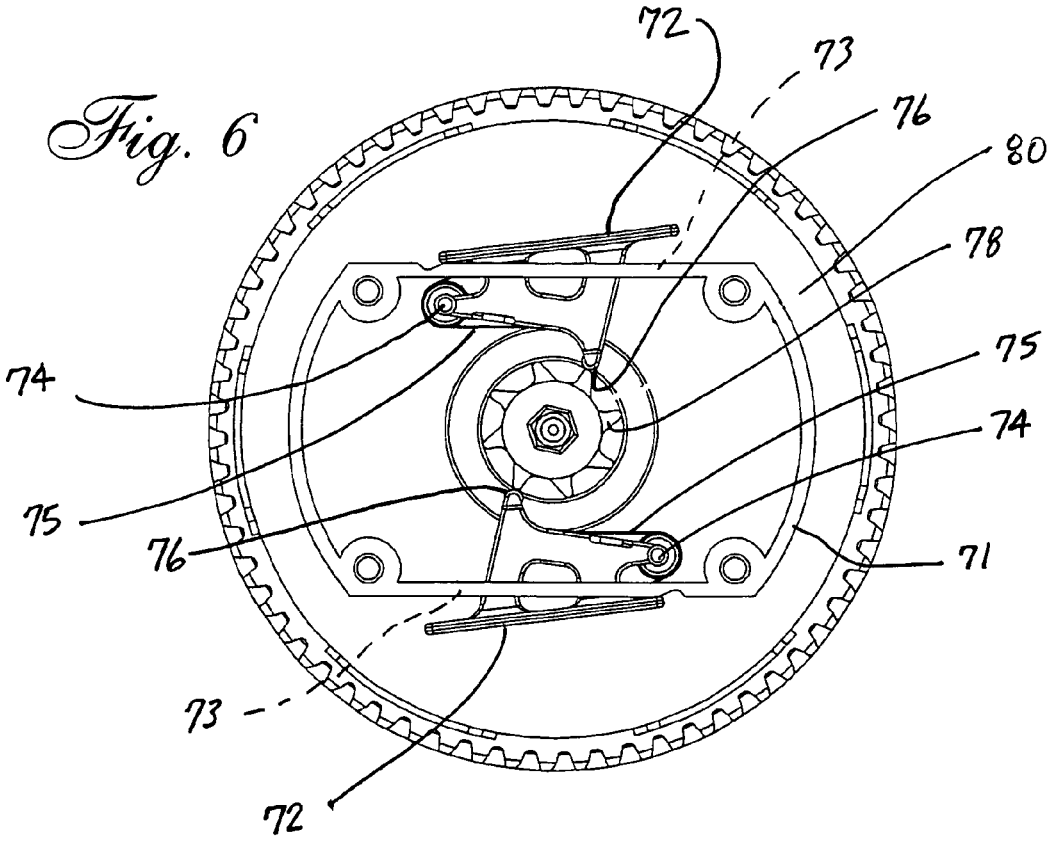
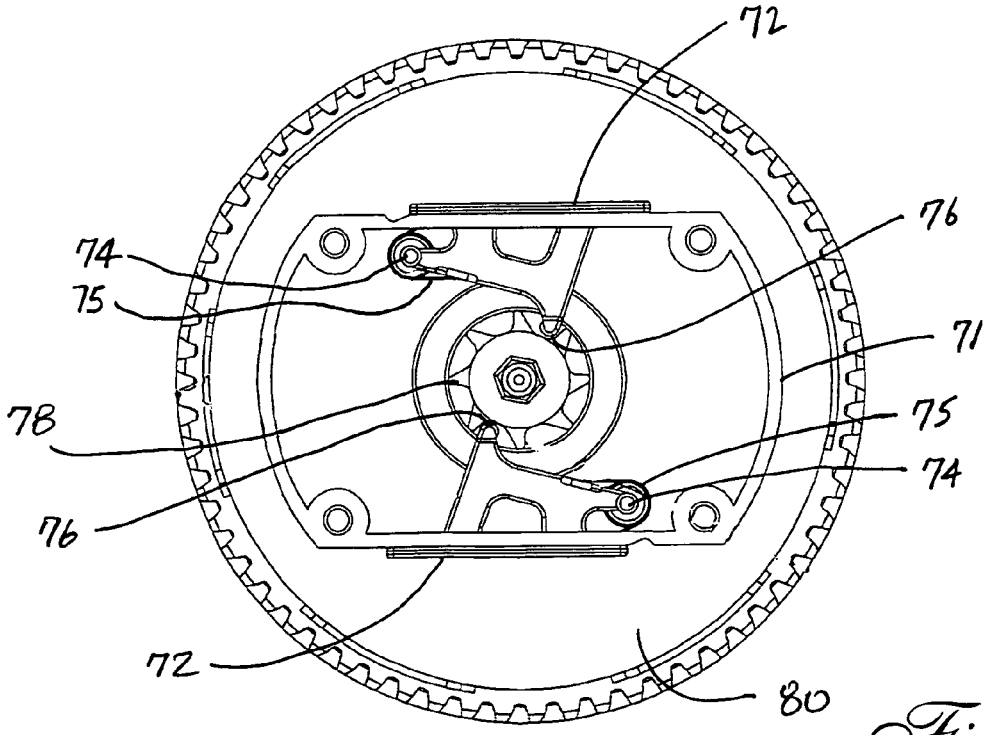
Fig. 4

FLOOR CLEANING APPARATUS WITH FILTER CLEANING SYSTEM

TECHNICAL FIELD

The present invention relates generally to the floor care equipment field and, more particularly, to a vacuum cleaner, extractor or the like equipped with a pneumatic mechanism for cleaning dirt and debris from the filter including, particularly, fine dirt particles from the pores of the filter in order to enhance filter cleaning efficiency and extend filter service life.

BACKGROUND OF THE INVENTION

A vacuum cleaner is an electromechanical appliance utilized to effect the dry removal of dust, dirt and other small debris from carpets, rugs, fabrics or other surfaces in domestic, commercial and industrial environments. In order to achieve the desired dirt and dust removal, most vacuum cleaners incorporate a rotary agitator. The rotary agitator is provided to beat dirt and debris from the nap of the carpet or rug while a pressure drop or vacuum is used to force air entrained with this dirt and debris into the nozzle of the vacuum cleaner. The particulate laden air is then drawn into a dirt collection vessel. The air is then drawn through a filter before being directed through the motor of the suction generator to provide cooling. Finally, the air is filtered to remove any fine particles of carbon from the brushes of that motor or other dirt that might remain in the airstream before being exhausted back into the environment.

Often the dirt collection vessel is designed to produce cyclonic airflow by providing that vessel with a dirt chamber having a cylindrical sidewall and a tangentially directed air inlet. This arrangement forces the air to swirl around the dirt collection chamber in the manner of a cyclone. The centrifugal force that is produced causes dirt and debris to move toward and against the cylindrical sidewall of the chamber while relatively clean air may be drawn off from the center of the chamber through the filter toward the suction generator.

Under most operating conditions most or all of the dirt and debris is removed from the airstream by the cyclonic airflow. At times, however, some dirt and debris remains entrapped within the airstream. Typically, that dirt and debris is relatively fine dirt particles of light weight which are not as susceptible to the centrifugal separation force produced by the cyclonic airflow. Over time such fine particles may become entrapped and fill the pores of the filter media thereby restricting airflow and reducing the cleaning efficiency of the vacuum cleaner. Eventually the cleaning efficiency of the vacuum cleaner becomes so impaired it is necessary for the operator to either clean or change the filter in order to achieve the desired level of cleaning. The present invention relates to a vacuum cleaner, extractor or the like equipped with a more efficient and effective filter cleaning mechanism. Advantageously, the present invention allows one to quickly and easily clean dirt and debris from a filter including particularly fine particles from the pores of the filter. As a result each filter has a longer service life and the apparatus may be operated at a higher cleaning efficiency over the entire length of that extended service life.

SUMMARY OF THE INVENTION

In accordance with the purposes of the present invention as described herein, an improved floor cleaning apparatus is provided. That apparatus comprises a housing and a dirt collection vessel held in that housing. The dirt collection vessel includes a dirty air inlet, a clean air inlet, a dirt collection chamber and a clean air outlet. A filter is received in the dirt collection vessel. The filter includes multiple sections. Each section provides a discrete airflow pathway. In addition a suction generator is carried on the housing. Further, a flow control valve assembly is provided. The flow control valve assembly is selectively displaceable between (a) a first position wherein dirty air is moved by the suction generator serially through the dirty air inlet, the dirt collection vessel, the filter and the clean air outlet whereby dirt is collected in the dirt collection chamber and (b) a second position wherein clean air is serially moved by the suction generator through the clean air inlet, a selected section of the filter, back through the other sections of the filter and then the clean air outlet whereby dirt is cleaned from the selected section of the filter.

More specifically describing the invention the housing includes a nozzle assembly and a canister assembly. A suction inlet is provided on the nozzle assembly. A rotary agitator is carried on the nozzle assembly adjacent the suction inlet. The dirt collection vessel is carried on the canister assembly. Further the canister assembly may be pivotally connected to the nozzle assembly.

The flow control valve assembly may include an actuator. The actuator may take the form of, for example, (1) a manual twist knob, (2) a stepper motor, a cooperating gear drive assembly and an activation switch or (3) a solenoid and an activation switch. The flow control valve assembly also includes a first flow valve for selectively opening and closing the clean air inlet and a second flow valve for selectively closing and opening the dirty air inlet. The flow control valve assembly further includes a first valve cam, an air guide, a second valve cam on the air guide, a first cam follower on the first flow valve and a second cam follower connected to the second flow valve. The first cam follower engages the first valve cam and the second cam follower engages the second valve cam. The first valve cam, the second valve cam and the air guide are mounted for rotation relative to the dirt collection vessel and the filter. The second cam follower is carried on a shaft mounted for reciprocating motion relative to the dirt collection vessel and filter. A spring biases the second cam follower into engagement with the second valve cam.

The filter is substantially cylindrical in shape. Each section of the filter defines an arc of A° and the air guide includes an air feed conduit also defining an arc of A°. In one possible embodiment the filter is divided into eight sections each having an arc of 45°.

In accordance with still additional aspects of the present invention the apparatus further includes a prefilter. The dirt collection chamber, the prefilter and the second flow valve are all substantially cylindrical in shape. The second flow valve is concentrically received in the prefilter and the prefilter is concentrically received in the dirt collection chamber. A seal extends between one end of the second flow valve and the prefilter. In addition a support is provided for holding the prefilter in the dirt collection chamber.

Still further describing the invention the dirt collection vessel includes a dirt cup section and a lid section. The lid section includes the dirty air inlet, the clean air inlet, the clean air outlet and a cavity for holding the filter.

In one possible embodiment of the present invention, a clicker is provided for engaging the filter. A motor is provided for driving or rotating the clicker relative to the filter. Alternatively, that motor may drive or rotate the filter relative to the clicker. In either instance, the clicker functions to vibrate dirt loose from the filter during the rotation or cleaning cycle.

In accordance with yet another aspect of the present invention the floor cleaning apparatus may be described as comprising a housing including a suction inlet and a dirt cup receiver, a dirt cup held in the dirt cup receiver, a filter received in the dirt cup, a suction generator carried on the housing, a clicker for engaging the filter and vibrating dirt and debris therefrom and a motor for driving or rotating the clicker or, in the alternative, the filter.

In accordance with another aspect of the present invention a method is provided for cleaning a filter in a floor cleaning apparatus. The method comprises compartmentalizing the filter into multiple sections, each section providing a discrete airflow pathway. Additionally the method includes moving a dirty airstream in a first direction through the multiple sections of the filter so as to filter dirt and debris from the dirty airstream. Further the method includes the step of moving a clean airstream in a second, opposite direction through at least one but less than all of the multiple sections so as to remove dirt and debris from that section of the filter.

In accordance with yet another aspect of the present invention, a method is provided for cleaning a filter in situ in a floor cleaning apparatus using a clicker. In one possible embodiment, the method includes rotating the filter against a stationary clicker. In another possible embodiment the method includes rotating the clicker against the stationary filter.

In the following description there is shown and described several preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of this specification, illustrates several aspects of the present invention, and together with the description serves to explain certain principles of the invention. In the drawing:

FIG. 4 is a schematical plan view illustrating the first flow valve in the first position allowing normal vacuum cleaner operation;

FIG. 6 is a schematical plan view similar to FIG. 4 but showing the first flow valve in the second position allowing air to be drawn through the clean air inlet;

Reference will now be made in detail to the present preferred embodiments of the invention, examples of which are illustrated in the accompanying drawing figures.

DETAILED DESCRIPTION OF THE INVENTION

Figure 1:
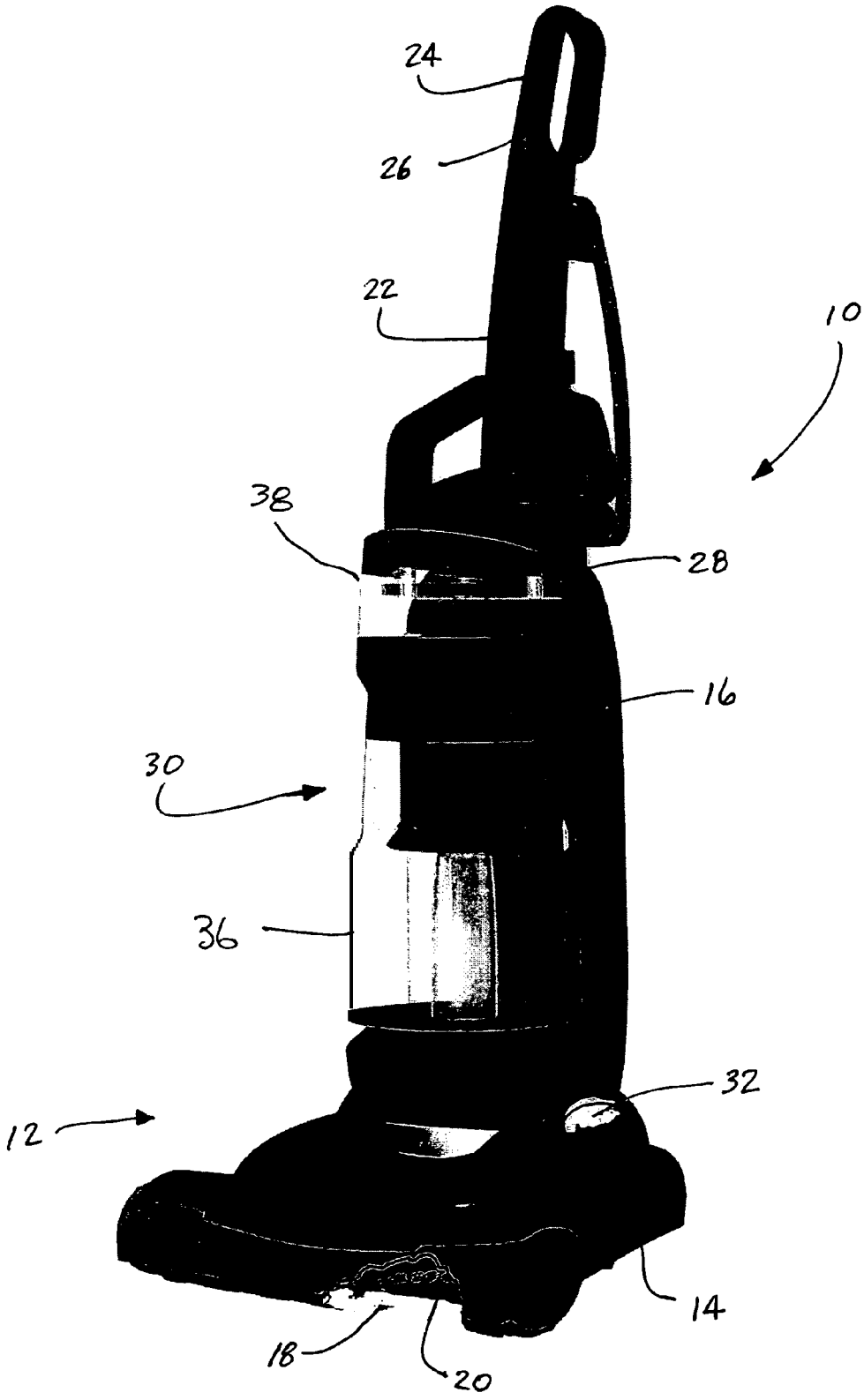
FIG. 1 is a perspective, partially broken-away view of the floor cleaning apparatus of the present invention.

Reference is now made to FIG. 1 which illustrates the floor cleaning apparatus 10 of the present invention. In the illustrated embodiment, the floor cleaning apparatus 10 comprises an upright vacuum cleaner. It should be appreciated, however, that the apparatus 10 may just as easily be a canister vacuum cleaner, a handheld vacuum cleaner or even an extractor.

As illustrated, the apparatus 10 includes a housing 12 including both a nozzle assembly 14 and a canister assembly 16. The nozzle assembly 14 includes a suction inlet 18 through which air entrained with dirt and debris is drawn into the vacuum cleaner. A rotary agitator 20 is mounted to the nozzle assembly 14 and extends across the suction inlet 18.

The canister assembly 16 includes a handle 22 having a handgrip 24. An actuator switch 26 for turning the vacuum cleaner on and off is provided adjacent the handgrip. In addition the canister assembly 16 includes a cavity or receiver 28 for receiving and holding a dirt collection vessel 30. A suction generator 32 is mounted in a compartment in the canister assembly 16. During operation, the rotary agitator 20 beats dirt and debris from the nap of the rug or carpet being cleaned. The suction generator 32 draws air entrained with that dirt and debris through the suction inlet 18 into the dirt collection vessel 30. The dirt and debris is trapped in the dirt collection vessel 30 and the now relatively clean air passes through and over the motor of the suction generator 32 to provide cooling before being exhausted through an exhaust port (not shown) back into the environment.

Figure 2:
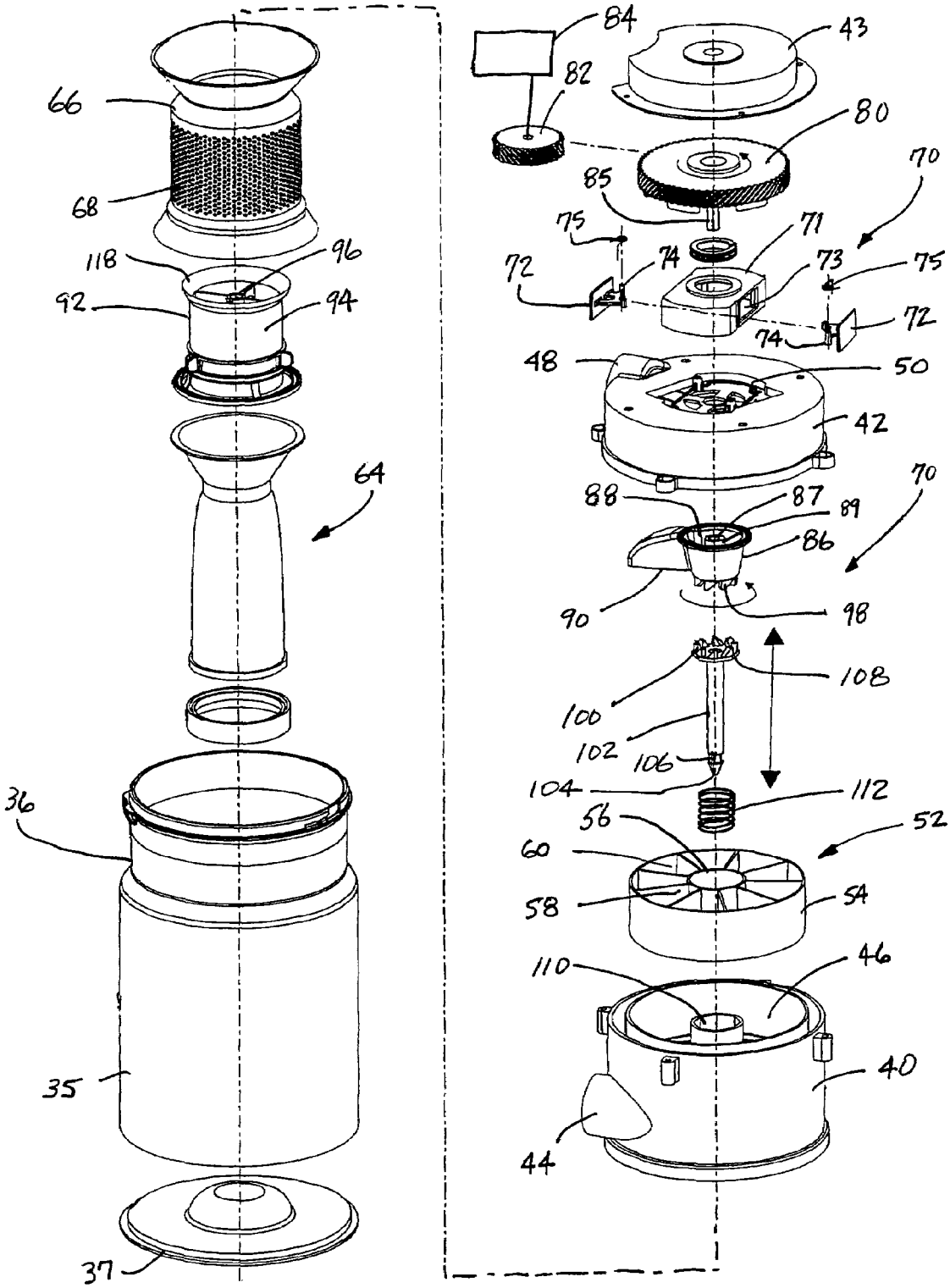
FIG. 2 is an exploded perspective view of the dirt collection vessel, filter and flow control valve assembly of the apparatus illustrated in FIG. 1.

As best illustrated in FIG. 2, the dirt collection vessel 30 comprises a dirt cup section 36 and a lid section 38. The dirt cup section 36 comprises a stepped sidewall 35 and a bottom wall 37. The lid section 38 comprises a first element 40, second element 42 and third element 43. The first element 40 includes the dirty air inlet 44 and a filter cavity 46. The second element 42 includes a clean air outlet 48 and a clean air inlet 50.

Figure 7:
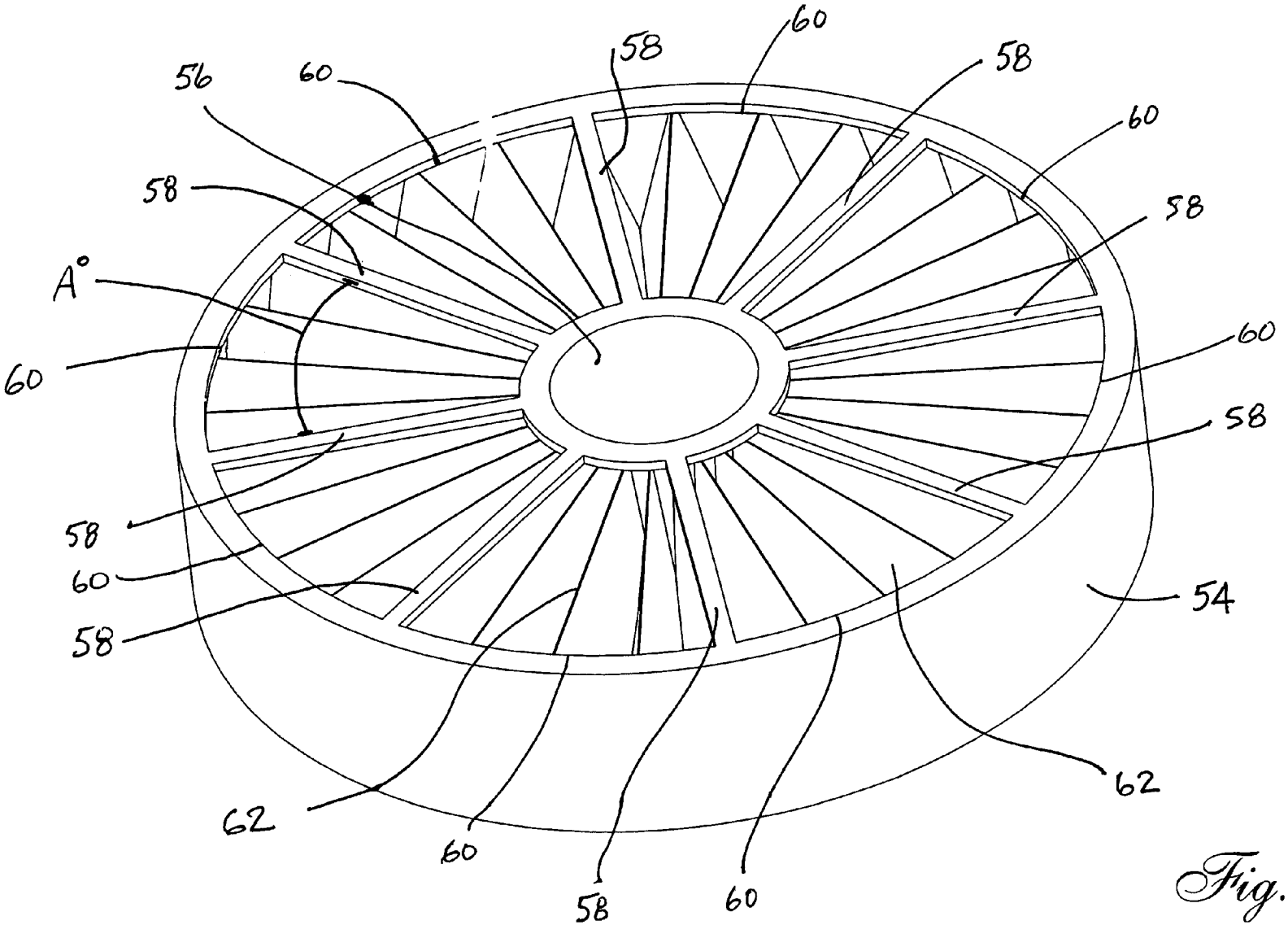
FIG. 7 is a detailed top perspective view of the filter assembly.

A filter, generally designated by reference numeral 52, is received in the filter cavity 46 of the first element 40. The filter 52 includes a sidewall 54, a hub 56 and multiple partitions 58 extending between the hub and the sidewall (see also FIG. 7). The partitions 58 serve to divide the filter 52 into multiple sections 60. A filter media 62, of a type well known in the art, extends between the sidewall 54, hub 56 and partitions 58 defining each section 60.

An inner support 64 extends upwardly in the dirt cup section 36 from the bottom wall 37. A prefilter 66 rests on the inner support 64. The prefilter 66 includes a series of intake apertures 68 that allow airflow in a manner that will be described in greater detail below.

Figure 3:
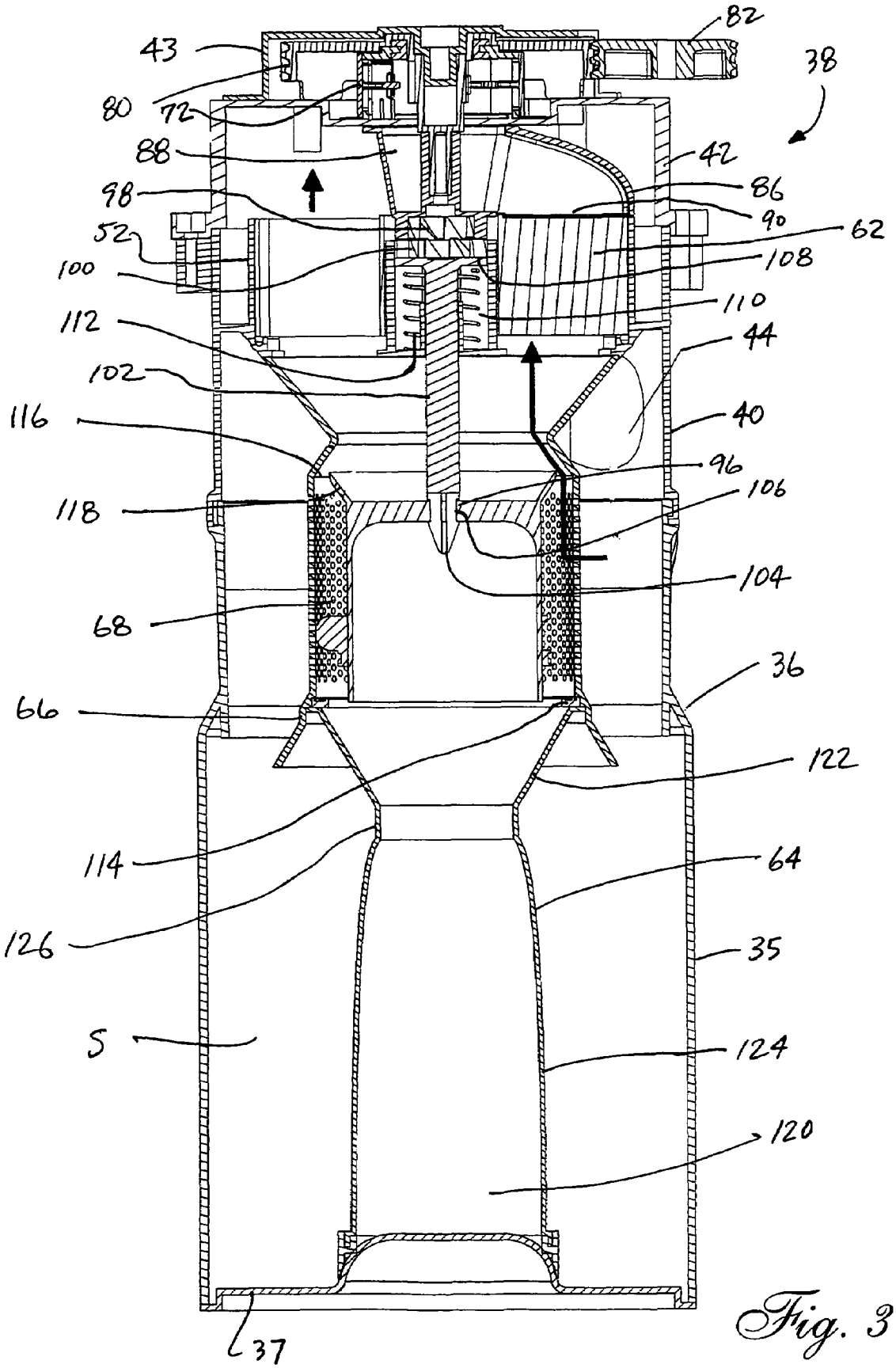
FIG. 3 is a cross-sectional view of the dirt collection vessel, filter and flow control valve assembly in the first position allowing for normal vacuum cleaner operation.
Figure 5:
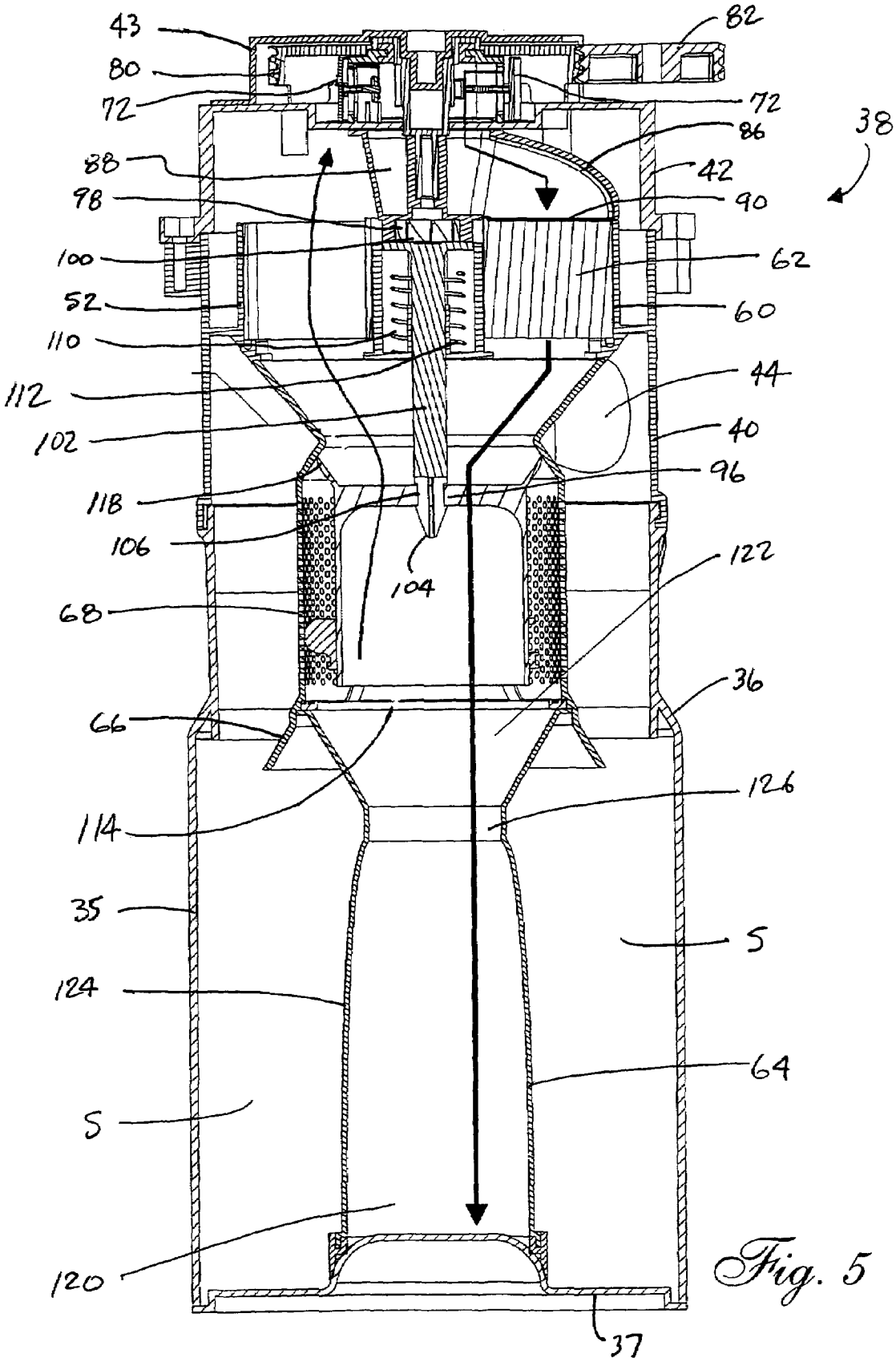
FIG. 5 is a cross-sectional view similar to FIG. 3 but illustrating the flow control valve assembly in the second position allowing cleaning of a section of the filter.

In the illustrated embodiment, the dirt collection vessel 30 is designed to produce cyclonic airflow and thereby use centrifugal force to improve the efficiency with which dirt and debris are removed from the airstream. More specifically, as clearly illustrated in FIG. 2, the dirt cup section 36, the lid section 38, the inner support 64, the prefilter 66 and the filter 52 are all substantially cylindrical in shape. As illustrated in FIGS. 3 and 5, the inner support 64 and prefilter 66 are concentrically received in the sidewall 35 of the dirt cup section 36. The filter 52 is concentrically received in the filter cavity 46 of the first element 40 of the lid section 38. The dirty air inlet 44 is tangentially directed into the annular space S formed between (a) the first element 40 and sidewall 35 on the outside and (b) the inner support 64 and prefilter 66 on the inside. The airstream flows around the annular space S in a circular or vortex pattern generating centrifugal force that causes dirt and debris in the airstream to move outwardly toward the sidewall 35 thereby causing the dirt and debris to collect in the dirt cup section 36. Simultaneously, the relatively clean air is drawn through the intake apertures 68 provided in the prefilter 66 along the inner wall of the annular space S where it is then directed upwardly through the filter 52. Specifically, the air passes through the filter media 62 where any fine dirt and debris remaining in the airstream is stopped while clean air passes through the media on through the clean air outlet 48 to the suction generator 32. The direction of airflow during normal vacuum cleaner operation is shown by action arrows in FIG. 3.

The flow control valve assembly of the present invention is generally designated by reference numeral 70. As best illustrated in FIG. 2, the flow control valve assembly 70 comprises a first flow valve 72 carried by a cooperative valve body 71 that covers the clean air inlet 50. As best illustrated in FIGS. 4 and 6, two first flow valves 72 are each pivotally connected to the valve body 71 by a pivot pin 74. A torsion spring 75 is provided on each first flow valve 72. The torsion springs 75 function to bias the first flow valves 72 into a first position, illustrated in FIG. 4 wherein the first flow valves 72 close the two opposed ports 73.

Each first flow valve 72 includes a first cam follower 76. Each cam follower 76 engages a first cam 78 mounted to or integrally formed on the underside of a first drive gear 80. The drive gear 80 is driven by an actuator. In the illustrated embodiment the actuator comprises a meshing second drive gear 82 and a cooperating stepper motor 84. In alternative embodiments the actuator may comprise, for example, a manual twist knob/finger wheel or an electrical solenoid and activation switch. The operation of the stepper motor 84 and the first flow valve 72 will be described in greater detail below.

As further illustrated in FIG. 2, an air guide 86 is keyed to the first drive gear 80. More specifically, the first drive gear 80 includes a hexagonal shaft 85 that is received in a hexagonal opening 87 provided in the hub 89 of the air guide 86. As should also be appreciated, the air guide 86 includes an inlet 88 and an outlet 90. The inlet 88 extends concentrically around the hub 89 while the outlet 90 projects radially outwardly in an arc of A° (see also FIG. 7).

Referring back to the filter 52, each section 60 also has an arc of A°. In the illustrated embodiment, the filter 52 includes eight partitions 58 dividing the filter 52 into eight equal sections 60, each spanning a 45° arc. Thus, the outlet 90 of the air guide 86 also spans a 45° arc, matching the arc of each individual section 60 of the filter 52. Of course, sections of other sizes could be provided (e.g. 12 sections each having an arc of 30°, 10 sections each having an arc of 36°, 9 sections each having an arc of 40°, 6 sections each having an arc of 60°).

The flow control valve assembly 70 also includes a second flow valve 92. The second flow valve 92 includes an outer sidewall 94 and a mounting hub 96 concentrically received in that outer sidewall. A second cam 98 is provided on the air guide 86. A cooperating second cam follower 100 engages the second cam 98. The second cam follower 100 includes a mounting shaft 102 having a pointed end 104 and a channel 106. The pointed end 104 is extended into the mounting hub 96 of the second flow valve 92 and that hub engages in the channel 106 so as to secure the second flow valve to the mounting shaft 102.

As further illustrated in FIG. 2, the second cam follower 100 includes a hexagonal head 108. The hexagonal head 108 is received in the hexagonal opening 110 in the first element 40 so that the second cam follower 100 is keyed to the lid section 38 to prevent relative rotation. A coil spring 112 is received around the shaft 102 and held in the hexagonal opening 110 in the hub of the first element 40. The spring 112 biases the second cam follower 100 into engagement with the second cam 98 at all times. As best illustrated in FIGS. 3 and 5, the second flow valve 92 is concentrically received within the prefilter 66. An annular seal 114 is connected between the lower margin of the second flow valve 92 and the wall of the prefilter 66. The annular seal 114 extends fully circumferentially between these two components.

The operation of the flow control valve assembly 70 will now be described in detail. During normal vacuum cleaner operation, the suction generator 32 draws air from the suction inlet 18 through the dirt collection vessel 30 where dirt and debris is trapped and then exhausts clean air from the exhaust port. In order to do this, the flow control valve assembly 70 is positioned as illustrated in FIGS. 3 and 4 so that the first flow valve 72 closes the ports 73 leading to the clean air inlet 50 and the second flow valve 92 opens the annular passage 116 between the angled flange 118 at the top of the second valve 92 and the sidewall of the prefilter 66 so that air may pass from the annular space S through the intake apertures 68 and the filter media 62 of the filter 52 before passing through the outlet 48 to the suction generator 32.

As the vacuum cleaner continues to operate, fine dirt particles not removed from the airstream by the cyclonic action in the annular space S is stripped from the airstream and trapped by the filter media 62 of the filter 52. Over time, these fine dirt particles begin to close off the pores in the filter media 62 thereby restricting airflow. This not only causes the motor of the suction generator 32 to run hotter and at a lower efficiency, it also reduces airflow thereby adversely affecting the cleaning efficiency of the vacuum cleaner. Consequently, the airflow may become so restricted as to prevent the vacuum cleaner from cleaning properly. It is then necessary to either clean or replace the filter 52.

The present invention allows the filter 52 to be cleaned in situ in a very convenient and efficient manner. Specifically, the stepper motor 84 may be activated to rotate the air guide 86 through an arc of 45° by means of the meshing drive gears 80, 82. This functions to rotate the air guide 86 so that the outlet 90 thereof is exactly aligned over or in registration with one of the sections 60 of the filter 52. The rotation of the first drive gear 80 simultaneously causes the first cam 78 to rotate from the position shown in FIG. 4 to the position shown in FIG. 6. As this occurs, the cam followers 76 rise up on the first cam 78 and the first flow valves 72 pivot about the pins 74 opening the ports 73 leading to the clean air inlet 50.

As the stepper motor 84 rotates the drive gear 80, first cam 78 and air guide 86, the second cam 98 is also rotated. The second cam follower 100 rides upward on the cam 98 raising the second flow valve 92 so that the upper edge thereof engages the prefilter 66 above the intake apertures 68 around its full circumference. Thus, it should be appreciated that as the ports 73 open through movement of the first flow valve 72, the second flow valve 92 closes the air passage from the prefilter 66 to the outlet 48. Accordingly, the suction generator 32 draws clean air through the ports 73 and the clean air inlet 50. That air is then drawn through the inlet 88 of the air guide 86 and then directed by the outlet 90 thereof through the single individual section 60 of the filter 52 with which the outlet is aligned. Since the clean air is moving through the selected section 60 of the filter 52 in a direction opposite that of normal operation, dirt (and particularly fine dirt from the pores of the filter), is forced from the filter media 62. The dirt expelled from the section 60 of the filter 52 being cleaned has a tendency to be trapped in the lumen or particle trap 120 of the inner support 64. This is due in large degree to the shape of the support which includes a frustoconical upper end 122 connected to a substantially cylindrically shaped lower end 124 by an intermediate bottleneck section 126 of smaller circumferential opening than the lower end. The relatively clean air is then drawn back through the other sections 60 of the filter 52 not aligned with the outlet 90 of the air guide 86 before passing through the outlet 48 and moving on to the suction generator 32.

As should be remembered, the outlet 90 of the air guide defines an arc only as wide as one section 60 of the filter 52. In the presently illustrated embodiment that section has an arc of 45°. This means the remaining sections of the filter 52 not aligned with the air guide 86 define an arc of 315°. This is a much larger cross-sectional area than the 45° arc through which the air initially passes. The resulting pressure drop helps to insure that dirt and debris cleaned from the section 60 of the filter aligned with the air guide 86 falls out of the airstream downwardly into the particle trap 120 of the support 64 where it is retained. Accordingly, the fine dust and dirt particles cleaned from the selected section 60 of the filter 52 are not thereby deposited on the other sections of the filter during the cleaning cycle.

The cleaning cycle may last, for example, from about 1 to about 30 seconds and more typically from about 3 to about 15 seconds. The stepper motor 84 may then be activated again to rotate the first and second drive gears 80, 82, the first cam 78 and the second cam 98 to thereby move the first flow valves 72 from the open position to the closed position and the second flow valve 92 from the closed position to the open position (i.e. move the flow valves 72, 92 from the positions illustrated in FIGS. 5 and 6 to the positions illustrated in FIGS. 3 and 4). This returns the vacuum cleaner 10 to normal operation where dirt and debris are drawn from the suction inlet 18 through the dirty air inlet 44 into the dirt collection vessel 30. There cyclonic airflow utilizes centrifugal force to efficiently remove dirt and debris from the airstream. That dirt and debris is captured in the annular space S of dirt cup section 36 as relatively clean air is drawn through the intake apertures 68 of the prefilter 66. That air then passes through the passage 116 to the filter 52 where any remaining fine particles are stripped from the airstream before it passes through the outlet 48 and travels to the suction generator 32. The airstream then cools the motor of the suction generator 32 before being exhausted back into the environment through the exhaust port. Of course, it should be appreciated that the stepper motor 84 may just as easily be activated so as to clean any number of the filter sections 60 before returning to normal operation mode, depending on the judgment of the vacuum cleaner operator.

Figure 8:
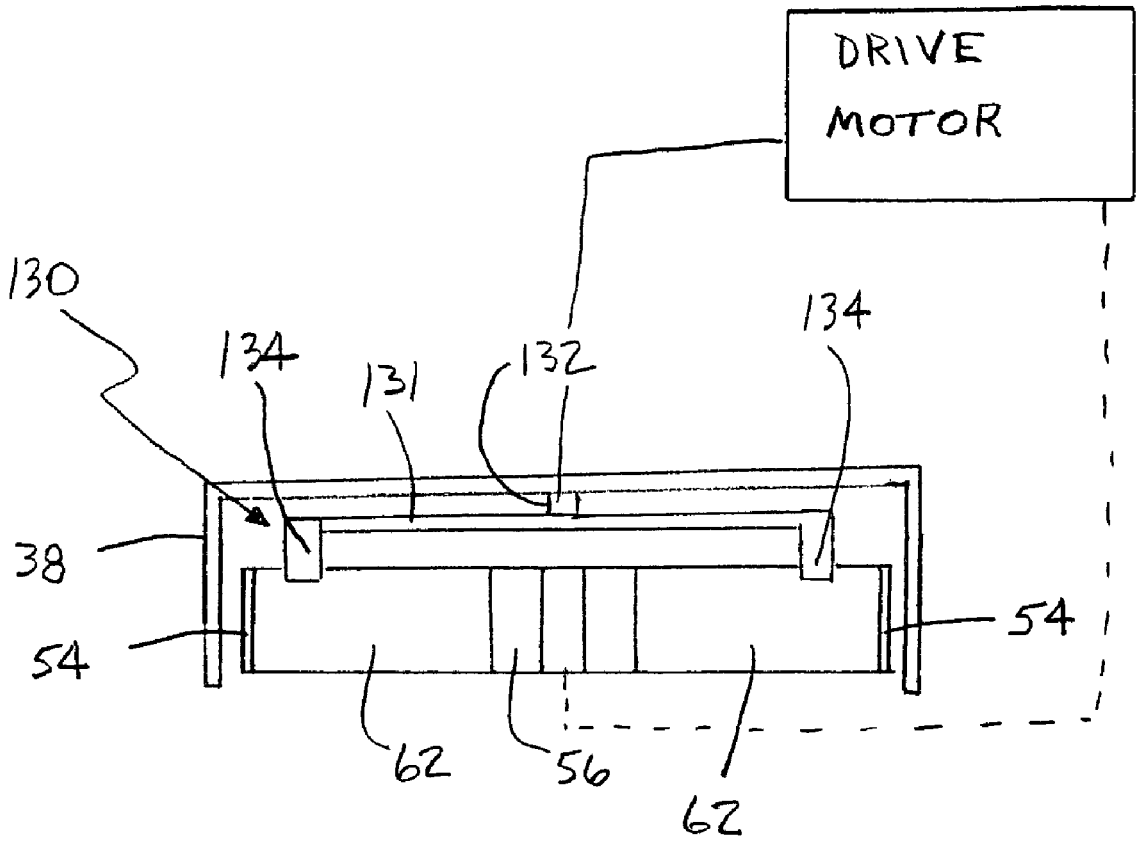
FIG. 8 is a schematical illustration of an additional filter cleaning feature that may be utilized to clean dirt and debris from the filter in situ in the dirt collection vessel.

Reference is now made to FIG. 8 schematically illustrating an optional additional feature of the present invention that may be provided to further enhance the cleaning of the filter 52. A clicker 130 may be provided. In the illustrated embodiment the clicker 130 includes an elongated mounting arm 131 that is held on a stub shaft 132 secured to the lid section 38. A resilient flap 134 is provided at each end of the arm 131. As illustrated the tips of the flaps 134 engage the media 62 of the filter 52 between the sidewall 54 and the hub 56. A drive motor 136 is provided. As illustrated in full line in FIG. 8 the drive motor may be connected to the clicker 130 and activated to rotate the clicker with respect to the lid section 38 and the filter 52. As the clicker 130 is rotated, the tips of the flaps 134 engage the peaks of the ribbed filter material 62 thereby vibrating the filter material and effectively loosening dirt and debris from the pores thereof. While the vibration provides good cleaning action when utilized alone, it is particularly effective when utilized with the pneumatic cleaning mechanism previously described in this document.

In an alternative arrangement also illustrated in FIG. 8, the drive motor is connected to the filter 52 (note dash line in drawing FIG. 8). In this arrangement the filter 52 is rotated while the clicker 130 and lid section 38 remain stationary. The result is the same in that the tips of the flaps 134 engage the peaks of the ribbed filter media 62 as the filter is rotated thereby vibrating the media and loosening dirt and debris therefrom.

The foregoing description of a preferred embodiment of the present invention has been presented for purposes of illustration and description. It is not intended to be exhaustive or to limit the invention to the precise form disclosed. Obvious modifications or variations are possible in light of the above teachings. For example, the air guide 86 of the illustrated and described embodiment extends through an arc of A° matching each section 60 of the filter 52. The air guide 86 may in fact have an arc that is a multiple of A° so as to allow the cleaning of more than one section of the filter at one time. Further, the filter cleaning function may be automatic. It may be automatically initiated after a certain time period of operation or upon some event occurring such as the movement of the control handle 22 into the upright or storage position. Further, it should be appreciated that clean air from the suction generator exhaust can be recycled to clean the filter.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed:

1. A floor cleaning apparatus, comprising:

a housing;

a dirt collection vessel held in said housing, said dirt collection vessel including a dirty air inlet, a clean air inlet, a dirt collection chamber and a clean air outlet;

a filter received in said dirt collection vessel, said filter including multiple sections, each section providing a discrete airflow pathway;

a suction generator carried on said housing; and a flow control valve assembly, said flow control valve assembly being selectively displaceable between (a) a first position wherein dirty air is serially moved by said suction generator through said dirty air inlet, said dirt collection chamber, said filter and said clean air outlet whereby dirt is collected in said dirt collection chamber and (b) a second position wherein clean air is moved by said suction generator through said clean air inlet, a selected one of said sections of said filter, back through other of said sections of said filter and then said clean air outlet whereby dirt is cleaned from said selected section of said filter;

said flow control valve assembly further including (a) a first flow valve for selectively opening and closing said clean air inlet, (b) a second flow valve for selectively closing and opening said dirty air inlet, (c) a first valve cam, (d) an air guide, (e) a second valve cam on said air guide, (f) a first cam follower on said first flow valve and (g) a second cam follower connected to said second flow valve.

2. The floor cleaning apparatus of claim 1, wherein said housing includes a nozzle assembly and a canister assembly.

3. The floor cleaning apparatus of claim 2, wherein a suction inlet is provided on said nozzle assembly.

4. The floor cleaning apparatus of claim 3, further including a rotary agitator carried on said nozzle assembly adjacent said suction inlet.

5. The floor cleaning apparatus of claim 4, wherein said dirt collection vessel is carried on said canister assembly.

6. The floor cleaning apparatus of claim 5, wherein said canister assembly is pivotally connected to said nozzle assembly.

7. The floor cleaning apparatus of claim 1, wherein said flow control valve assembly includes an actuator.

8. The floor cleaning apparatus of claim 7, wherein said actuator is a manual twist knob.

9. The floor cleaning apparatus of claim 7, wherein said actuator includes a stepper motor, a cooperative gear drive assembly and an activation switch.

10. The floor cleaning apparatus of claim 7, wherein said actuator includes a solenoid and an activation switch.

11. The floor cleaning apparatus of claim 1, wherein said first cam follower engages said first valve cam and said second cam follower engages said second valve cam.

12. The floor cleaning apparatus of claim 11, wherein said first cam, said second cam and said air guide are mounted for rotation relative to said dirt collection vessel and said filter.

13. The floor cleaning apparatus of claim 12, wherein said second cam follower is carried on a shaft mounted for reciprocating motion relative to said dirt collection vessel.

14. The floor cleaning apparatus of claim 13, further including a spring biasing said second cam follower into engagement with said second valve cam.

15. The floor cleaning apparatus of claim 14, wherein said filter is substantially cylindrical in shape and each said section of said filter defines an arc of A° and said air guide includes an air feed conduit also defining an arc of A°.

16. The floor cleaning apparatus of claim 15, wherein A°=30°, 36°, 40°, 45° or 60°.

17. The floor cleaning apparatus of claim 16, further including a prefilter.

18. The floor cleaning apparatus of claim 17, wherein (a) said dirt co1lection chamber is substantially cylindrical in shape, (b) said prefilter is substantially cylindrical in shape, (c) said second flow valve is substantially cylindrical in shape, (d) said second flow valve is concentrically received in said prefilter and (e) said prefilter is concentrically received in said dirt collection chamber.

19. The floor cleaning apparatus of claim 18, further including a seal extending between one end of said second flow valve and said prefilter.

20. The floor cleaning apparatus of claim 18, further including a support for holding said prefilter in said dirt collection chamber.

21. The floor cleaning apparatus of claim 20, wherein said dirt collection vessel includes a dirt cup section and a lid section, said lid section including said dirty air inlet, said clean air inlet, said clean air outlet and a cavity for holding said filter.

22. The floor cleaning apparatus of claim 21, further including a clicker carried on said lid section of said dirt cup, said clicker engaging and vibrating said filter so as to loosen dirt and debris.

23. The floor cleaning apparatus of claim 22, wherein said clicker is mounted for rotation with respect to said filter and said lid section and a drive motor is provided, said drive motor driving said clicker around a 360° arc against said filter.

24. The floor cleaning apparatus of claim 22, further including a drive motor that drives said filter around a 360° arc against said clicker.

* * * * *